US012071827B2

(12) United States Patent
Boyd et al.

(10) Patent No.: US 12,071,827 B2
(45) Date of Patent: Aug. 27, 2024

(54) MODULAR VALVE TREE

(71) Applicant: FMC Technologies, Inc., Houston, TX (US)

(72) Inventors: Gareth Boyd, Houston, TX (US); James Cook, Houston, TX (US); Bruno Freitas, Houston, TX (US); Christopher Adams-Hernandez, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 184 days.

(21) Appl. No.: 17/603,047

(22) PCT Filed: Apr. 14, 2020

(86) PCT No.: PCT/US2020/028079
§ 371 (c)(1),
(2) Date: Oct. 12, 2021

(87) PCT Pub. No.: WO2020/214568
PCT Pub. Date: Oct. 22, 2020

(65) Prior Publication Data

US 2022/0186577 A1 Jun. 16, 2022

Related U.S. Application Data

(60) Provisional application No. 62/834,193, filed on Apr. 15, 2019.

(51) Int. Cl.
*E21B 33/035* (2006.01)

(52) U.S. Cl.
CPC ..... *E21B 33/0353* (2020.05)

(58) Field of Classification Search
CPC ..... E21B 33/0353
See application file for complete search history.

(56) References Cited

U.S. PATENT DOCUMENTS 6,227,301 B1 5/2001 Edwards et al.
2012/0152564 A1 6/2012 Peltier
(Continued)

FOREIGN PATENT DOCUMENTS

CA 2950611 A1 1/2014
WO 2014164223 A2 10/2014

OTHER PUBLICATIONS

International Search Report issued in International Application No. PCT/US2020/028079 dated Aug. 4, 2020 (4 pages).
(Continued)

*Primary Examiner* — Cathleen R Hutchins
*Assistant Examiner* — Ronald R Runyan
(74) *Attorney, Agent, or Firm* — Osha Bergman Watanabe & Burton LLP

(57) ABSTRACT

A modular valve tree may have two or more blocks. Additionally, a first block may have a flow passage therethrougt, with an inlet and an outlet and a second block may have a flow passage therethrough with including an inlet and an outlet. Further, an insert may be provided comprising sealing elements. The insert may be partially disposed within each of the first block and the second block and the insert has a throughbore fluidly connecting the first block outlet to the second block inlet. Furthermore, the sealing elements are configured to seal external surfaces of the insert against an internal surface of the respective flow passages. A retention system may retain the blocks in position and compress and engage one or more of the sealing elements.

13 Claims, 10 Drawing Sheets

(56) References Cited

U.S. PATENT DOCUMENTS

| | | | | |
|---|---|---|---|---|
| 2013/0075080 | A1* | 3/2013 | Guidry | E21B 43/26 285/302 |
| 2014/0020906 | A1* | 1/2014 | Travis | E21B 33/03 166/368 |

OTHER PUBLICATIONS

Written Opinion issued in International Application No. PCT/US2020/028079 dated Aug. 4, 2020 (6 pages).

* cited by examiner

MODULAR VALVE TREE

FIELD OF THE DISCLOSURE

Embodiments disclosed herein relate generally to oil and gas production equipment. More particularly, embodiments disclosed herein relate to a compact modular valve tree.

BACKGROUND

Production and fracturing equipment is often connected to wellheads or valve blocks used for the extraction of hydrocarbons from subterranean and/or subsea formations. Production equipment connected to a wellhead may include a production Christmas tree connected to the upper end of the wellhead housing. The Christmas tree controls and distributes the fluids produced from the wellbore. Valves are typically provided within Christmas trees for controlling the flow of oil or gas from a wellhead and/or for controlling circulating fluid flow in and out of a wellhead. The Christmas tree may control the flow of the hydrocarbons to production equipment disposed at a distance from the wellhead, such as a flowline hub. Similarly, frac trees may be used to control the flow of fluids into and from the wellbore during fracturing operations. Additionally, the Christmas tree may provide access points for wireline operation and various other subsea operations.

Conventional trees comprise an assembly of valves and piping components. For example, as shown in FIG. 1, a tree 1 may include one or more swab valves 10, one or more main valves 15, and one or more cross blocks 20 (cross-flow piping components). Each valve and piping component is provided as a separate piece, to be attached to the pieces disposed above and below it via flanged piping spools 25. A typical spool piece 25 may include six, eight, or more bolts per flange connecting adjacent valves or blocks. To assemble, perform maintenance, or otherwise access the components, each bolt may have to be torqued, and each connection may have to be tested whenever a tree is assembled or reassembled, which may require significant time, personnel, equipment, and cost. The spool pieces additionally increase the overall height of the tree.

Composite block trees represent an alternative to the conventional trees as shown in FIG. 1. Composite block trees may include a single block of material in which all of the necessary valves and cross-flow components are formed.

Composite block trees require significantly less assembly time than conventional trees. However, composite block trees are difficult and time-consuming to repair, as individual components cannot be removed therefrom. In other words, it is not possible to replace one piece of a composite block tree because all of the pieces are formed within or as a single block.

In view of the shortcomings of conventional trees and composite block trees, there is a need for a tree structures and system which allows for quick assembly and reassembly, while also permitting replacement of parts.

SUMMARY OF THE DISCLOSURE

In contrast to the standard trees as described above, embodiments herein make each vertical segment of a tree (e.g., valves and flow crosses) into its own modular block. The blocks may then be stacked and coupled together at once, rather than using spools and bolted flanges between each of the segments, as is done now. The blocks may be maintained as a unit using strength arms or threaded posts, for example. One of the primary benefits of configurations according to embodiments herein is that it reduces the height of the frac tree or Christmas tree, so that it fits within DOT regulations for standard transportation to the wellsite. In a non-limiting example, a plurality of protrusions and corresponding indents on the blocks may provide additional strength to an assembly unit as well as being an alignment guide.

The modular valve trees of some embodiments herein may include replaceable or non-replaceable seat pockets. By using the replaceable or non-replaceable seat pockets, the necessary sealing between the adjacent blocks is accomplished. Further, the internal bonnet design for the sealing may allow for expansion of the block, which gives the room required to drill through bores and/or connections for the threaded posts or strength arms, respectively. In this manner, a pre-packaged tree structure may be assembled according to embodiments herein, where a master valve (MV), flow cross, and swab valve are connected and shipped to the field for installation. In some embodiments, a quick connector hub may be located below the MV to attach to the pre-packaged tree structure to a wellhead or a lower master valve (LMV) in place at the wellhead.

In one aspect, embodiments herein relate to a modular valve tree which may have two or more blocks. Additionally, a first block may have a flow passage therethrougt, with an inlet and an outlet and a second block may have a flow passage therethrough with including an inlet and an outlet. Further, an insert may be provided comprising sealing elements. The insert may be partially disposed within each of the first block and the second block and the insert has a throughbore fluidly connecting the first block outlet to the second block inlet. Furthermore, the sealing elements are configured to seal external surfaces of the insert against an internal surface of the respective flow passages. A retention system may retain the blocks in position and compress and engage one or more of the sealing elements.

In another aspect, embodiments herein relate to a modular valve tree that may include a first gate valve block; a second gate valve block disposed adjacent to and fluidly connected to the first gate valve block; a cross flow block disposed adjacent to and fluidly connected to the second gate valve block; a third gate valve block disposed adjacent to and fluidly connected to the cross flow block; a first insert sealingly disposed within a seat pocket of the first gate valve block and a seat pocket of the second gate valve block; a second insert sealingly disposed within a seat pocket of the second gate valve block and a seat pocket of the cross flow block; a third insert sealingly disposed within a seat pocket of the cross flow block and the third gate valve block; and a retention system configured to retain each of the blocks in position and compress and engage one or more sealing elements of the first insert, the second insert, and the third insert.

In yet another aspect, embodiments herein relate to a method of assembling a modular valve tree that may include disposing an insert within a seat pocket of a first block; disposing a second block adjacent to the first block, wherein a portion of the insert is disposed within a seat pocket of the second block; assembling a retention system configured to retain the blocks in position, wherein assembly of the retention system compresses and engages one or more sealing elements of the insert.

Other aspects and advantages will be apparent from the following description and the appended claims.

DETAILED DESCRIPTION

Figure 1:
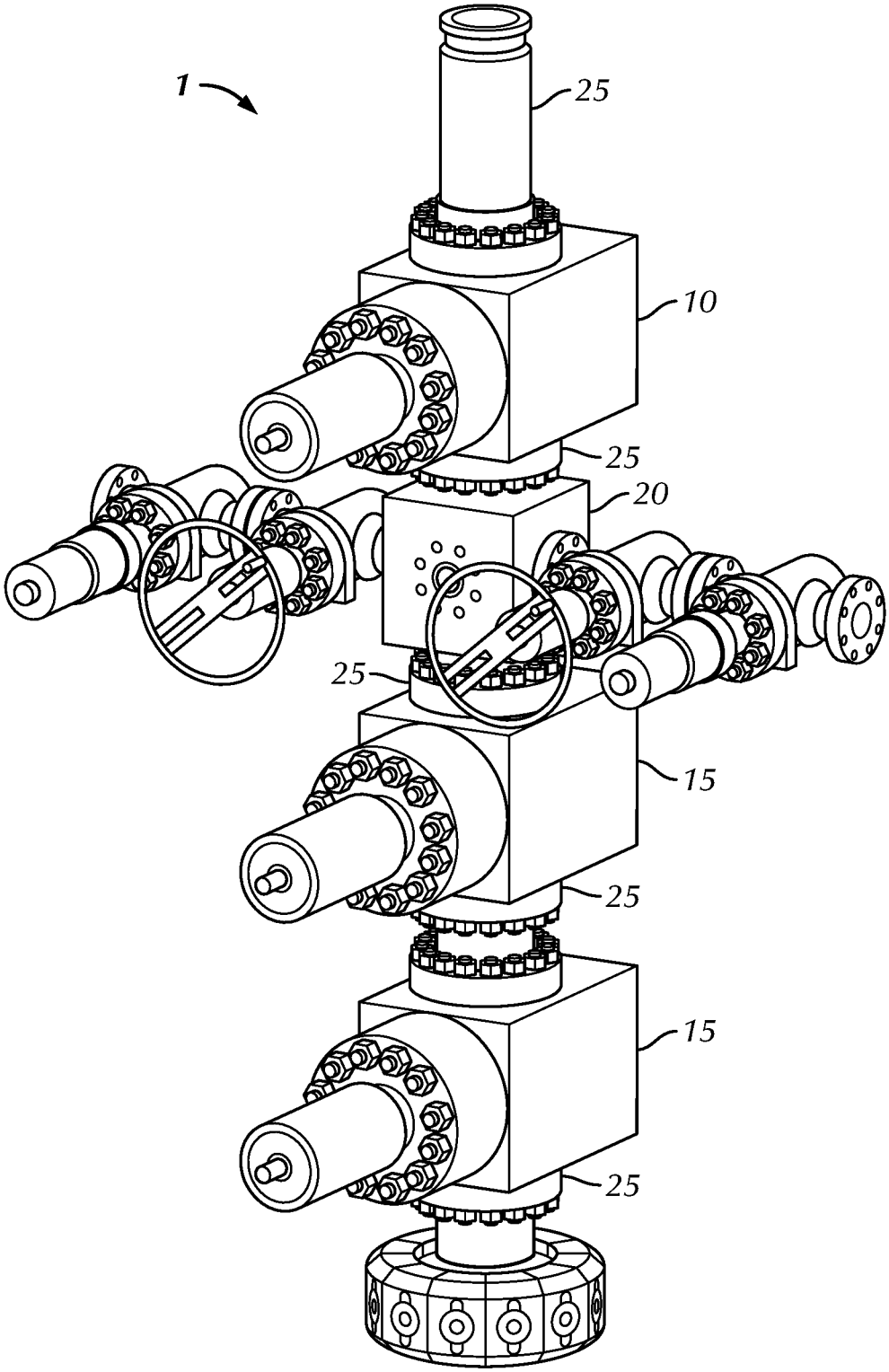
FIG. 1 (Prior Art)
FIG. 1 is a perspective view of a prior art Christmas tree assembly.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Further, embodiments disclosed herein are described with terms designating a tree or valve block reference to a block with at least one bore that may be used to control and regulate the flow of fluids for purposes of either injecting fluid (such as a frac fluid) into an injection well or recovering hydrocarbons (such as reservoir fluids, oil, and/or gas) from a production well. In addition, any terms designating tree or valve block (i.e., any wellheads or frac valves) at a rig type (i.e., any land rig or offshore rig) should not be deemed to limit the scope of the disclosure. As used herein, fluids may refer to slurries, liquids, gases, and/or mixtures thereof. It is to be further understood that the various embodiments described herein may be used in various stages of a well, such as rig site preparation, drilling, completion, abandonment etc., and in other environments, such as workover rigs, fracking installation, well-testing installation, oil and gas production installation, without departing from the scope of the present disclosure. It is recognized by the different embodiments described herein that a tree or valve block plays a valuable and useful role in the life of a well. Further, it is recognized that the fluid flow configuration and arrangement of components for a subsea tree according to one or more embodiments described herein may provide a cost effective alternative to conventional trees. The embodiments are described merely as examples of useful applications, which are not limited to any specific details of the embodiments herein.

As used herein, the term "coupled" or "coupled to" or "connected" or "connected to" "attached" or "attached to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

Embodiments herein are generally directed toward modular valve trees, such as Christmas trees or frac trees useful in systems for producing oil and gas. The modular valve trees may include two or more blocks, including valve blocks, flow blocks, or combinations thereof, compactly fluidly connected using seat pocket inserts fluidly connecting the blocks and sealing the inter-block flow bores and seat pockets so as to retain fluids within the flow passages of the blocks.

A modular valve tree according to embodiments herein may include two or more blocks. The two or more blocks may include, for example, a first block having a flow bore or passage therethrough, including an inlet and an outlet end, as well as a second block having a flow bore or passage therethrough, including an inlet and an outlet end. The two or more blocks may also include cross-bores, such as for insertion of valve elements or to connect to additional flow components.

The inlet and outlet ends of the flow bores through the blocks may include seat pockets. The seat pockets may be configured to receive a seat pocket insert, which may include one or more sealing elements A seat pocket insert may be partially disposed within each of a first block and a second block, and the seat pocket insert may include a throughbore fluidly connecting the first block outlet to the second block inlet, for example. The sealing elements may be configured to seal external surfaces of the seat pocket against an internal surface of the respective flow passage of the one or more blocks.

According to embodiments of the present disclosure, seat pocket inserts are apparatuses that may be used as a seat pocket and/or flow bore to hold a seat in one or more flow bores of a valve block, in fluid communication with a well, and be coupled to a body of the valve block. In one or more embodiments, seat pocket inserts may include an insert body axially extending from a first end surface to a second end surface and having a bore axially extending through the first end surface to the second end surface. The insert body may be inserted in a flow passage or cavity of at least one flow bore of the blocks (i.e., a seat pocket for a seat within the one or more flow bores). Additionally, the flow passage or cavity may be at an inlet or outlet.

Depending on size, pressure rating and style, a seal (e.g., elastomer or metal) may be included to sealingly attach a seat seal or valve seal to the seat pocket insert. For example, the seat pocket insert may be used in an inlet or outlet of a valve block, such as a gate valve, and a profile of the seat pocket insert may be sealingly coupled to a seat seal sealingly engaged with the gate of the valve. The seat seal may abut against a profile (seat pocket) of the seat pocket insert.

Further, a connection surface of the seat pocket insert may be coupled to a connection surface of one or both of the blocks, to lock the seat pocket insert within the one or more flow bores at an outlet or inlet of the respective blocks. For example, the connection surfaces of the seat pocket insert and a valve block may have threads that may be any type of threads, such as ACME threads, API threads, or specialty threads. It is further envisioned that the connection surfaces may include any mechanical coupler device to couple the seat pocket insert and the valve block together without departing from the present scope of the disclosure.

The modular valve tree may also include a retention system. The retention system may be configured to retain the two or more blocks in position and compress and engage one or more of the sealing elements. The retention system may include, for example, one or more threaded posts extending through the two or more blocks, and each of the two or more blocks comprises one or more through-holes to receive the threaded posts; nuts or other means may be tightened (torqued) to compress and engage one or more of the sealing elements. In other embodiments, the retention system may include one or more strength arms, and each of the two or more blocks may include one or more notches configured to engage the strength arms; compression of the blocks during attachment of the strength arms may compress and engage one or more sealing elements. It is further envisioned that the strength arms may be stretched to engage the one or more notches. One skilled in the art will appreciate how an elasticity of a material (i.e., steel or other metals) that the strength arms are made from may be used to provide compression force to the modular valve tree as the strength arms are stretched.

The two or more blocks may also include alignment features configured to align adjacent blocks during assembly of the modular valve tree. For example, an upper surface of a block may include tabs or posts, while a lower surface of a block may include slots or cavities for receiving the tabs or posts. The tab/slot (post/hole) configuration may thus allow alignment of blocks when lowering of a block onto another block. The alignment features may be arranged, for example, so as to properly align other features of the modular valve tree, such as inlet and outlet flow bores, cross-bores, valve assemblies, etc. The alignment features may additionally provide means to prevent rotation of a block and/or misalignment of the blocks, as such may introduce undesired stress on the seals associated with the seat pocket inserts.

The blocks of the modular valve tree may thus be fluidly connected using inter-block inserts, seat pocket inserts, or block-to-block inserts, where respective portions of the inserts may be disposed within a first block and a second block. As one skilled in the art would appreciate, the terminal blocks may include an inlet or an outlet not connected to another block of the modular valve tree, and these inlets or outlets may include inserts that do not include portions disposed in another block, and in some embodiments, may be flush with an outside of the block and/or may include bolt holes or other means for connecting to a flow pipe or flanged connection. For example, the modular valve tree, in some embodiments, may include two or more blocks arranged vertically, where an uppermost and/or a lowermost of the two or more blocks may include a insert configured to connect to a flanged or studded fluid connection or a blind flange.

The style of the inter-block inserts used may depend upon the types of blocks being connected. As noted above, the blocks of the modular tree may include cross-flow blocks, valve blocks, and combinations thereof, for example. An insert connecting two cross-flow blocks may require different elements and configurations than a insert connecting a cross-flow block to a gate valve block. Similarly, different elements and configurations may be required for connecting two gate valve blocks.

For inserts connecting a cross-flow block to another block, for example, the insert may include a first threaded portion configured to be disposed within a respective threaded portion of either the first block or the second block. The insert may also include a stab interface configured to be disposed within a respective receiving portion of the other of the first block and the second block. For example, an upper seat pocket of a valve or cross-flow block may be threaded and may receive a threaded end of a insert; a lower seat pocket of a cross-flow block may include a cavity or profile for receiving the stab end of the insert. The threaded end and the stab end of the insert may include sealing elements configured to seal an outer surface of the insert and an inner surface of the block seat pocket, so as to restrict flow to the flow bore of the insert providing a flow path between the first and second blocks.

For inserts connecting a valve block to another valve block, each respective seat pocket may include a threaded portion. For example, a insert or insert assembly for connecting two gate valve blocks may include a first threaded insert, a second threaded insert. The insert or insert assembly may include, in some embodiments, a first threaded insert configured to be disposed within a respective threaded seat pocket of a first block outlet. The modular block seat pocket insert or insert assembly may also include a second threaded insert configured to be disposed within a respective threaded seat pocket of the second block inlet. Each of the first and second threaded inserts may include a seat pocket for collectively receiving a sealing element, disposed within and sealing against each of the seat pockets of the first and second threaded inserts. For example, each of the inserts include a first end surface and a second end surface, where the first end surface may be internal to the block, and the second end surface may be proximate an outer boundary or surface of the block. The respective second end surfaces may include the seat pockets for collectively receiving a sealing element, while the respective first surfaces may each include a profile for coupling to a seat seal configured to engage the valve element, such as a gate of a gate valve. In this manner, a wear element may be provided to sealingly engage with the valve element. The block and/or the worn wear element may be readily withdrawn from the system and easily replaced without having to re-work the entirety of the tree.

In some embodiments, for example, a modular valve tree according to embodiments herein may include a first gate valve block. A second gate valve block may be disposed adjacent to and fluidly connected to the first gate valve block. A cross flow block may be disposed adjacent to and fluidly connected to the second gate valve block. Further, a third gate valve block may be disposed adjacent to and fluidly connected to the cross flow block. A first seat pocket insert may be sealingly disposed within a seat pocket of the first gate valve block and a seat pocket of the second gate valve block, and the first seat pocket insert may include a fluid passage to provide the fluid connection between the first and second gate valve blocks. A second seat pocket insert may be sealingly disposed within a seat pocket of the second gate valve block and a seat pocket of the cross flow block, and the second seat pocket insert may include a fluid passage to provide the fluid connection between the second gate valve block and the cross flow block. A third seat pocket insert may be sealingly disposed within another seat pocket of the cross flow block and a seat pocket of the third gate valve block, where the third seat pocket insert may include a fluid passage to provide the fluid connection between the cross flow block and the third gate valve block. The modular valve tree may also include retention system configured to retain each of the blocks in position and compress and engage one or more sealing elements of the first seat pocket insert, the second seat pocket insert, and the third seat pocket insert.

Modular valve trees may, of course, have alternative arrangements. In various embodiments, some trees may include a greater or fewer number of valve blocks or a greater or fewer number of cross flow blocks. Further, the valve blocks and cross flow blocks may be arranged in any order or configurations. For example, in some embodiments, the modular valve tree may include a lower master valve block and an upper master valve block. In other embodiments, the valve tree may include an upper master valve block configured to attach to a lower master valve block already present at a wellsite. In a non-limiting example, said lower master valve block may be connected to a wellhead at the wellsite via a lower adapter that is a flanged spool, or a radial bolt connector (e.g., a speedlock quick connect device) or any mechanical coupler.

In some embodiments, a modular valve tree may include multiple blocks arranged vertically. The vertical assembly may include one or more mater valve blocks disposed below a cross flow block and one or more swab valve blocks disposed above the cross flow block. The lowermost master valve block may be configured to connect to a wellsite, and the uppermost swab valve block may be configured to connect to an adapter to connect to a downstream or upstream component or a blind flange.

Figure 2:
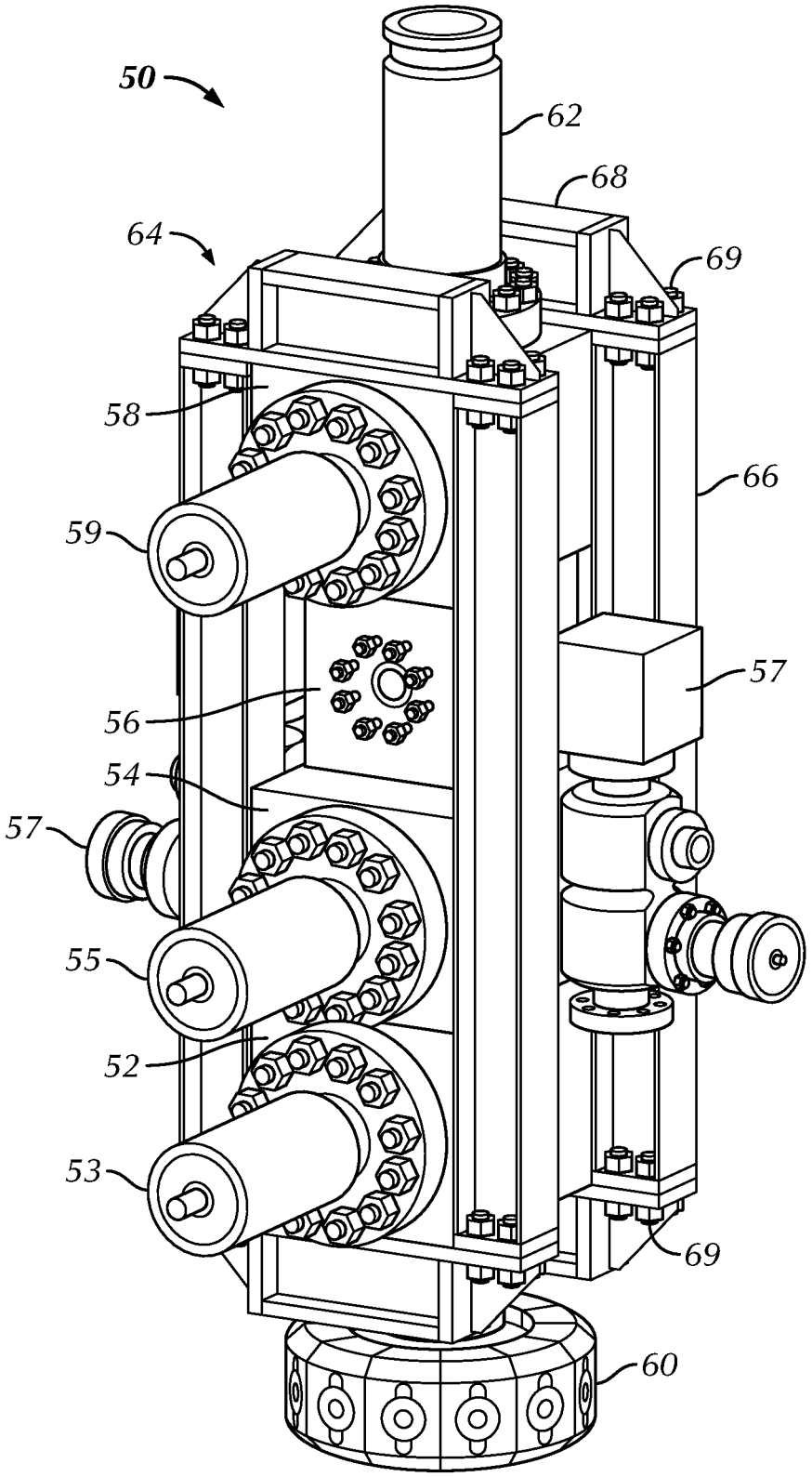
FIG. 2 is a perspective view of a modular tree assembly according to embodiments herein.

Referring now to FIG. 2, a perspective view of a modular valve tree according to embodiments herein is illustrated. As illustrated in FIG. 2, a modular valve tree 50 may include multiple blocks, including a lower master valve block 52, a master valve block 54, a cross-flow block 56, and a swab valve block 58. A continuous flow path (internal) from a lower adapter 60 to an upper adapter 62 may be provided, where each of the adjacent flow blocks may be fluidly connected via seat pocket inserts (described further below). The blocks 52, 54, 56, 58 may each include cross bores intersecting with the contiguous flow path, in which valve elements 53, 55, 59 may be disposed, or which may be connected to other fluid connections, such as a cross-bore of the cross-flow block 56 fluidly connecting to plug valve wing blocks 57. The blocks of the modular valve tree may be compressed and held in place by strength arms 64, which may include vertical bars 66 and horizontal bars 68 connected via bolts 69.

Figure 3:
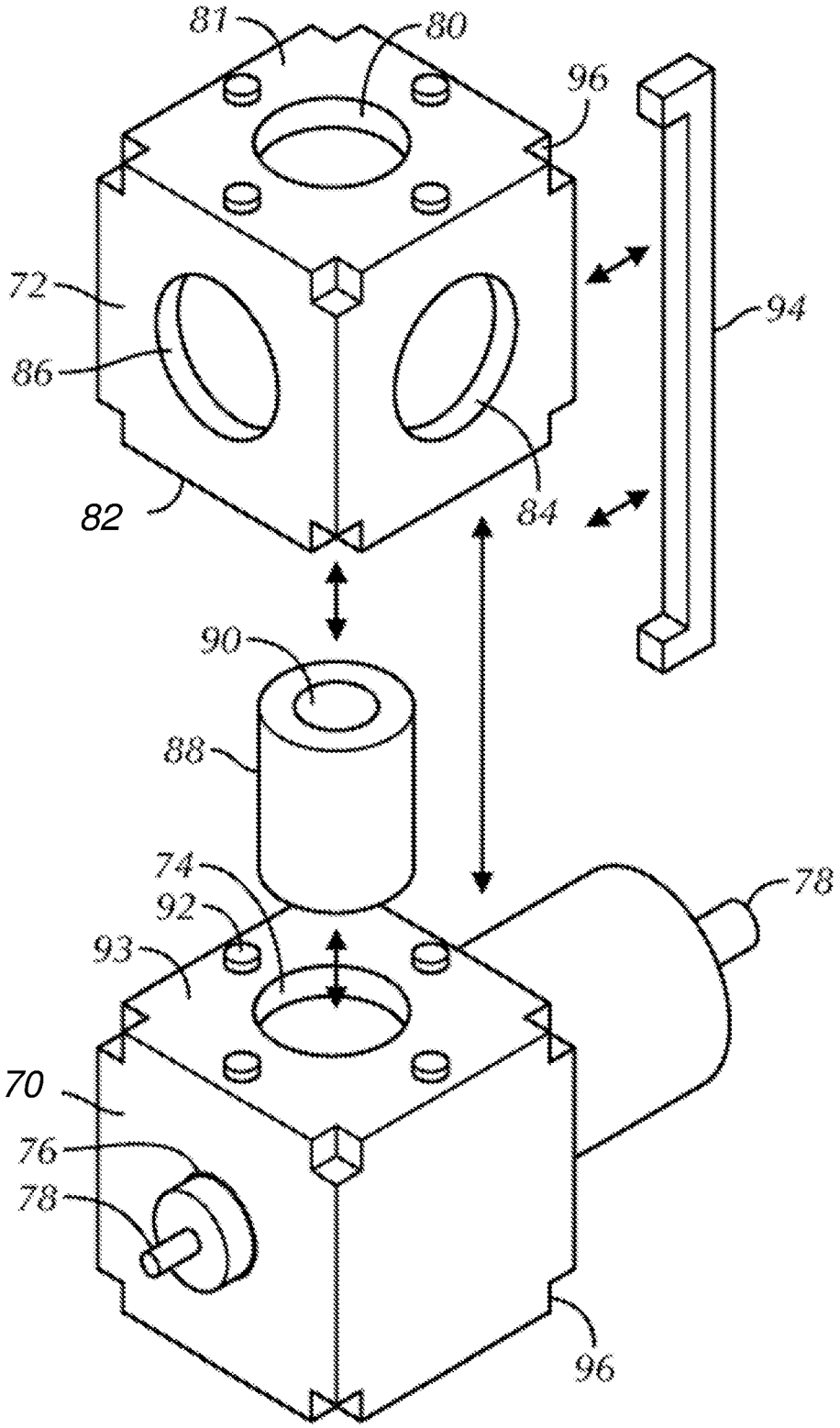
FIG. 3 is a perspective view of component parts forming a portion of a modular tree assembly according to embodiments herein.

As noted above, the blocks may be fluidly connected via seat pocket inserts to provide a continuous flow path. Referring now to FIG. 3, a perspective view of component parts forming a portion of a modular tree assembly according to embodiments herein is illustrated. The illustration in FIG. 3 is simplified, and more details of the component parts are provided below with respect to FIGS. 5-7.

As illustrated in FIG. 3, the modular tree may include a valve block 70 and a cross flow block 72. The valve block 70 may include a vertical bore 74 and an intersecting horizontal bore 76. Valve elements 78 may be connected to the valve block 70 and disposed within horizontal bore 76, where the valve elements may include a valve stem, a gate assembly, stem packing, a gate guide, a bonnet, an actuator or handwheel assembly, and other component parts that are commonly associated with a gate valve, for example.

Cross flow block 72 may include a vertical bore 80 extending from an upper surface 81 to a lower surface 82, as well as one or more horizontal bores 84, 86 extending between respective sides of the block. As illustrated, the cross flow block has three bores, each between opposite sides of the cube shaped block.

The vertical bores of the valve block 70 and the cross flow block 72 may be fluidly connected by a seat pocket insert 88. A lower portion of the seat pocket insert 88 may be disposed within a seat pocket portion of bore 74 of valve block 70, and an upper portion of the seat pocket insert 88 may be disposed within a seat pocket portion of bore 80 of cross flow block 72. Seals associated with the seat pocket inserts may provide for sealing between an internal wall of bore 74 and an outer surface of seat pocket insert 88, restricting flow to bore 90 of seat pocket insert 88 fluidly connecting bores 74, 80.

Alignment features may be provided to align the adjacent blocks 70, 72 during assembly of the modular valve tree. For example, an upper surface 93 of valve block 70 may include tabs or protrusions 92, while a lower surface of cross flow block 72 may include cavities or holes (not shown) for receiving the tabs or protrusions 92. The post/hole configuration may thus allow alignment of blocks 70, 72 when lowering of block 72 onto block 70, for example. The alignment features 92 may be arranged, for example, so as to properly align or organize, as desired, other features of the modular valve tree, such as flow bores 74, 80, cross-bores 76, 86, valve assemblies 78, etc.

A retention system may be provided to retain the two or more blocks in position and compress and engage one or more of the sealing elements. As illustrated in FIG. 3, the retention system may include one or more strength arms 94, and each of the blocks 70, 72 may include notches 96 configured to engage the strength arms 94. Compression of the blocks during attachment of the strength arms may compress and engage one or more sealing elements (not shown) of the seat pocket insert.

As can be envisioned, multiple valve or flow blocks bay be connected in the manner as illustrated in FIG. 3. The strength arms may be disposed, in some embodiments, to encompass the entirety of the blocks used in the modular valve tree. In other embodiments, strength arms may be connected between two adjacent blocks, such as at opposite corners, where a first and second block may be connected by a first pair of strength arms, and the second and a third block may be connected by a second pair of strength arms. In this manner, disassembly and replacement of one block or a seat pocket insert between two blocks may be effected without disassembly of the whole modular valve tree. For example, referring now to FIG. 4, a side elevation view of a modular tree assembly according to embodiments herein is illustrated, where the tree includes a lower master valve block 100, a master valve block 102, a cross flow block 104, a lower swab valve block 106, and an upper swab valve block 108. The upper and lower swab valve blocks 106, 108 may be combined as a first sub-unit 110 of the tree assembly, and the master valve block 102 and the cross flow block 104 may be combined as a second sub-unit 112 of the tree assembly. The tree may also include an upper adapter 114 for fluid connection of the upper swab valve block to upstream or downstream components, as well as valves or flow lines 116, 118 connected to cross bores of the cross flow block 104.

Figure 5:
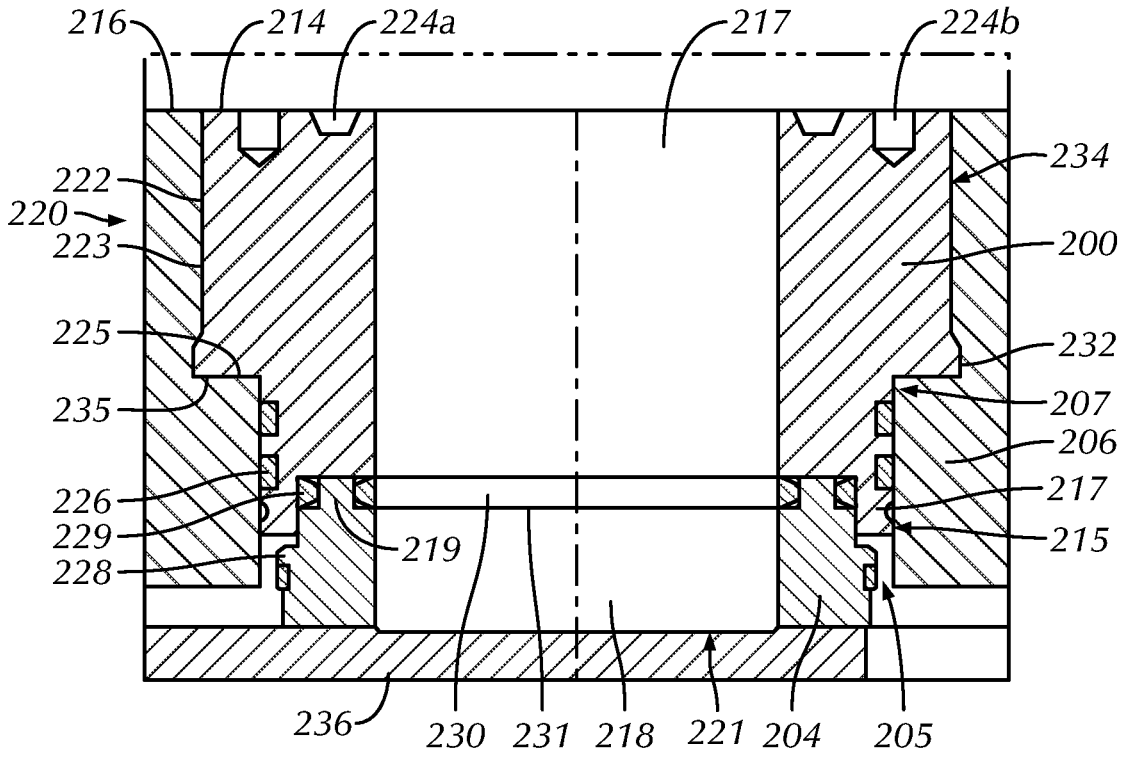
FIGS. 5-7 are cross-sectional views of seat pocket inserts for use in modular tree assemblies according to embodiments herein.
Figure 6:
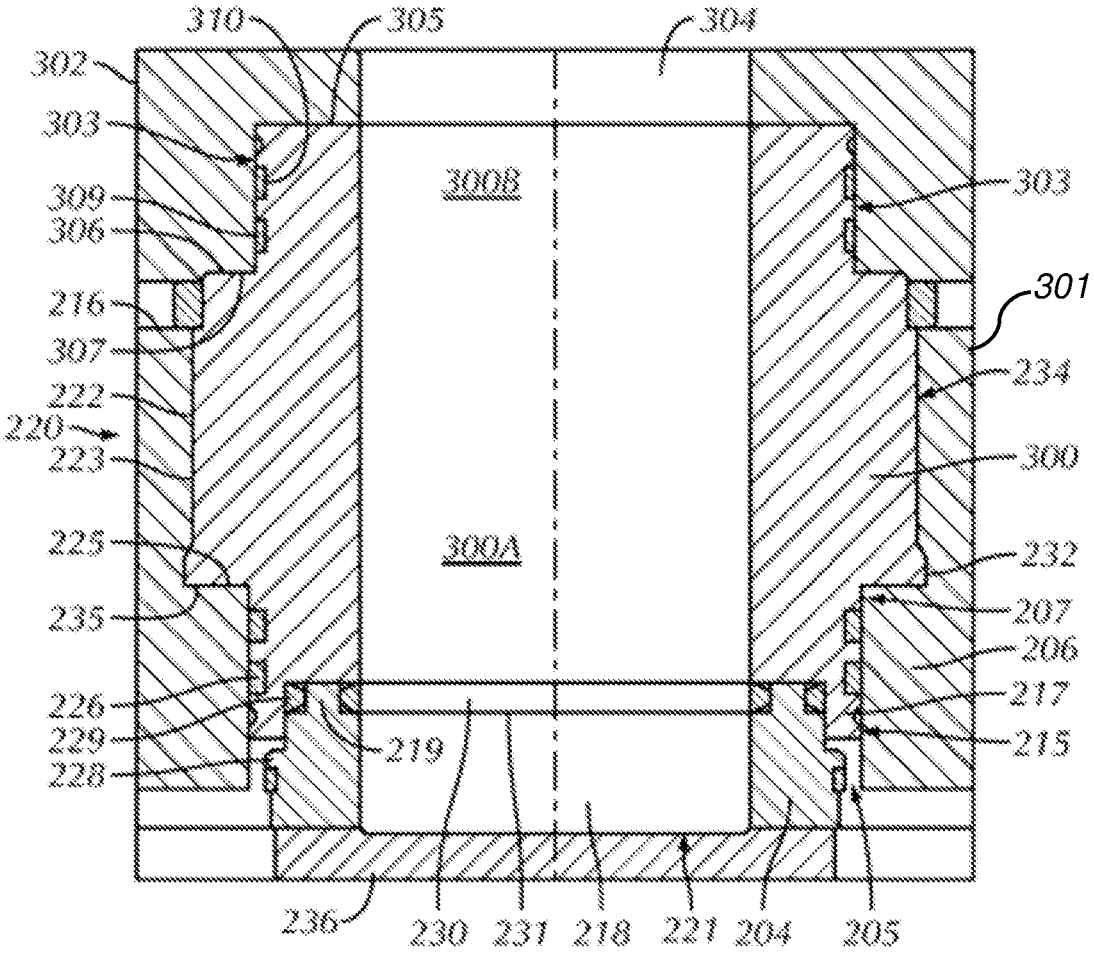
Figure 7:
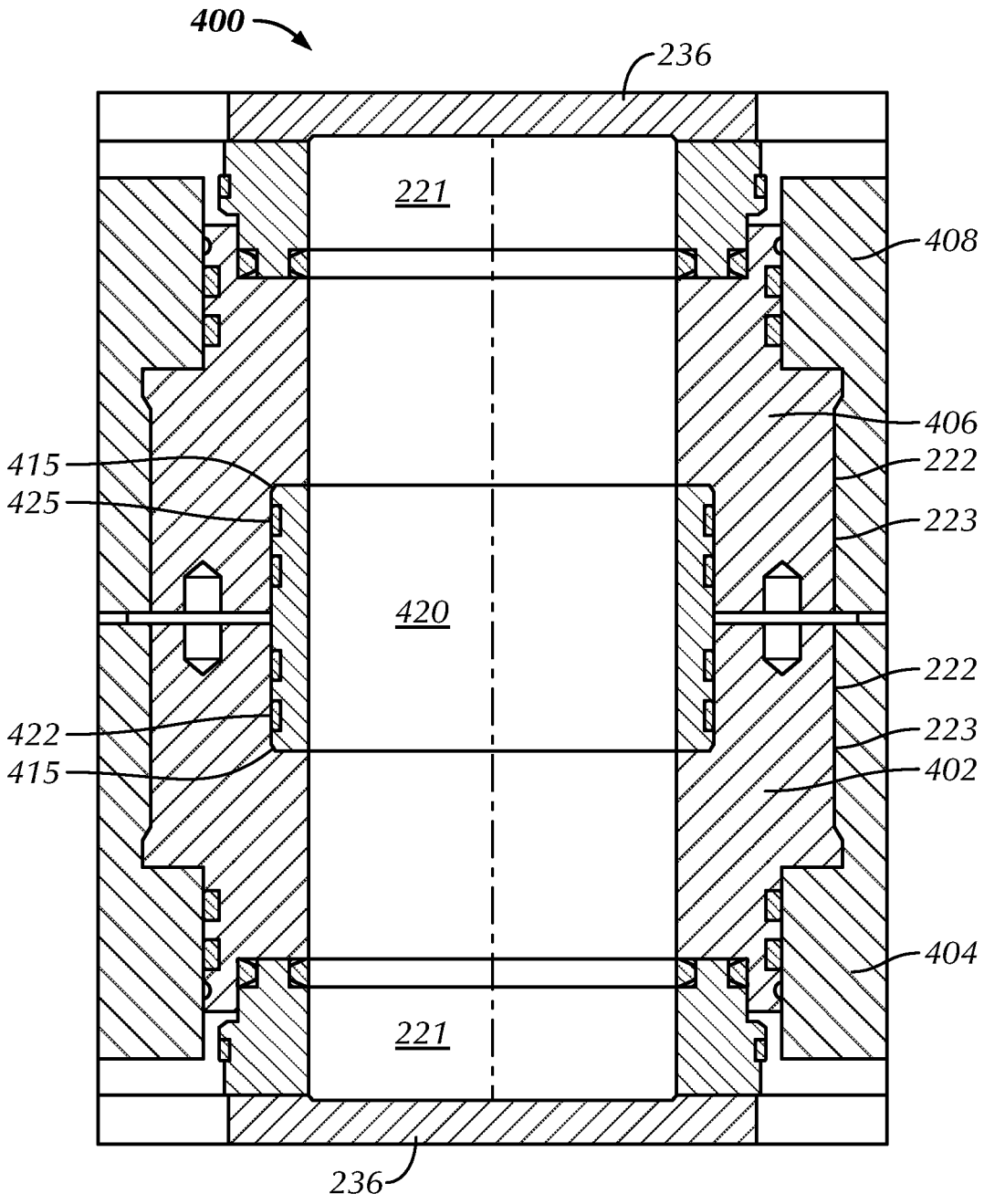

Turning to FIGS. 5-7, cross-sectional views of seat pocket inserts for use in modular tree assemblies according to embodiments herein are illustrated. FIG. 5 illustrates a seat pocket insert for use in a gate valve connection at a terminal end of the tree assembly, for example. FIG. 6 illustrates a seat pocket insert for use in coupling a gate valve block to a cross flow block. FIG. 7 illustrates a seat pocket insert for use in coupling two gate valves.

Figure 4:
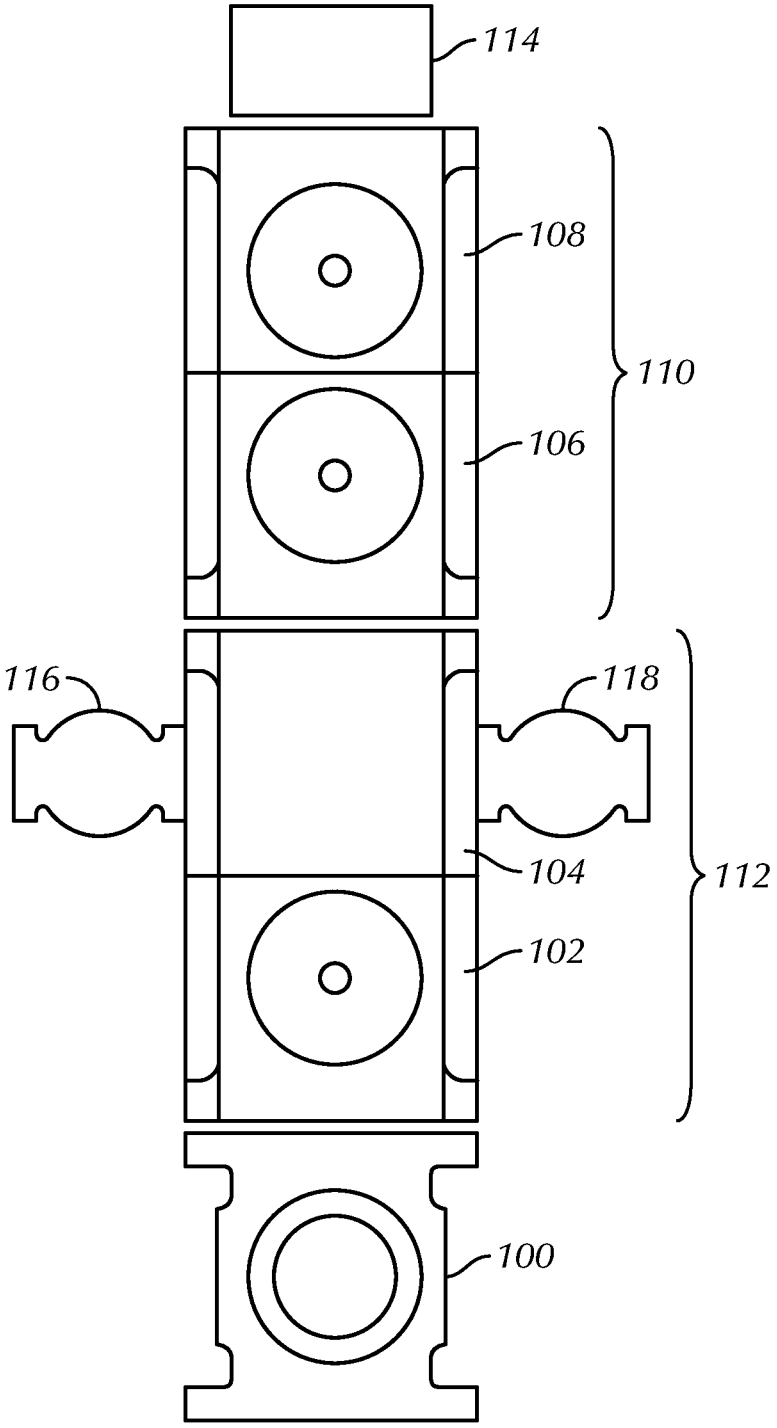
FIG. 4 is a side elevation view of a modular tree assembly according to embodiments herein.

Referring now to FIG. 5, in one or more embodiments, a cross-sectional view of a seat pocket portion of a valve block is illustrated. As noted above, this seat pocket insert is associated with a terminal end of the tree assembly, such as the upper swab valve illustrated in FIG. 4, where the seat pocket and seat pocket insert as shown in FIG. 5 may be associated with the vertical flow bore above the valve elements, terminating at an upper surface of the valve block and which may be configured to connect to adapter 114 (FIG. 4). As would be used at the other terminal end of the tree assembly, such as with the lower master valve of FIG. 4, the seat pocket insert as illustrated in FIG. 5 may be inverted.

As shown in FIG. 5, a seat pocket insert 200 may be inserted or disposed within an inlet or outlet end of a vertical flow bore 205 of a valve block body 206. Further, the flow bore 205 may have a seat pocket 207 for the first seat pocket insert 200 to be coupled into. In a non-limiting example, the first seat pocket insert 200 may be made of metal such as steel, iron, treated iron, or any metal alloy.

In one or more embodiments, the first seat pocket insert 200 may include an insert body extending, in an axial length, between a first end surface 214 and a second end surface 215. Additionally, when the first seat pocket insert 200 is fully inserted into the valve block body 206, the first end surface 214 may be flush with an outer surface 216 of the body 206. The first seat pocket insert 200 may have a bore 217 axially extending through the first end surface 214 to the second end surface 215 of the insert body. Further, the first seat pocket insert 200 may have a first portion 220 near the first end surface 214 and a second portion 221 near the second end surface 215. In a non-limiting example, the first portion 220 may have a connection surface 222 on an outer surface of the insert body. The connection surface 222 may have threads which may engage threads of a connection surface 223 within the body 206 of the valve block. For example, the connection surface 223 may be provided on a portion (e.g., a flow passage or cavity) of the vertical flow bore 205 to lock/retain the first seat pocket insert 200 within the valve block. One skilled in the art will appreciate how the threads on the connection surfaces 222, 223 may be any type of threads, such as ACME threads, API threads, or specialty threads. Further, the connection surfaces 222, 223 may be provided with a stress relief feature 232. In some embodiments, the first end surface 214 may have at least one torque connection (224*a*, 224*b*), e.g., a hole or tab, which may be used to apply torque on the first seat pocket insert 200. For example, a hammer or a wrench may be used to apply a force on a first torque connection 224*a* to rotate and torque the first seat pocket insert 200. Additionally, a second torque connection 224*b* provided on the first end surface 214 may be used to connect the valve block to any other components, subsea or otherwise, such as an adaptor 114 (FIG. 4). While it is noted that FIG. 5 shows four torque connections (224*a*, 224*b*) equally spaced apart, one of skill in the art would understand that this is merely a non-limiting example and any number of torque connections may be used without departing from the present scope of the disclosure. While it is noted that FIG. 5 shows threads on the connection surfaces 222, 223 to make-up the first seat pocket insert 200 to the valve block 206, one of skill in the art would understand that the use of threads is merely a non-limiting example and any suitable type of mechanical coupler may be used without departing from the present scope of the disclosure to couple the first seat pocket insert 200 to the valve block 206.

Still referring to FIG. 5, in one or more embodiments, an outer diameter of the first portion 220 is larger than an outer diameter of the second portion 221 to form an outer load shoulder 225 of the insert body. The outer load shoulder 225 may be used to abut the first seat pocket insert 200 against the body 206 of the valve block. Load shoulder 225 of the seat pocket insert 200 may abut, for example, a stop shoulder 235 of the valve body 206, thus providing a desired engagement of second portion 221, which may be a seat seal interacting with a gate 236 of the valve block. While it is noted that FIG. 5 shows the outer load shoulder 225 at a ninety-degree angle from the first portion, one of skill in the art would understand that this is merely a non-limiting example and the outer load shoulder 225 may be any angle without departing from the present scope of the disclosure. Additionally, the second portion 221 extends from the outer load shoulder 225. In some embodiments, the second portion 221 may include a plurality of seals 226 to seal an outer surface of the second portion 221 to the body 206 of the valve block. Additionally, the plurality of seals 226 to seal an outer surface of the portion 221 to the body 206 of the valve block. Additionally, the plurality of seals 226 may aid in preventing leaks between the first seat pocket insert 200 and the body 206 of the valve block. Further, the plurality of seals 226 may be elastomeric, plastic, or metallic.

In some embodiments, it is further envisioned that the second end surface 215 of the first seat pocket insert 200 may have a profile 219 to receive and sealingly engage the seat seal (second portion 221). The profile 219 may be machined to match a shape of the seat, such that the profile 219 is a seat pocket for the seat to abut against. Fluids may be used to float the seat 204 such that the seat 204 is received into profile 219 and a protrusion 227 of the first seat pocket insert 200 abut against a shoulder 228 of the seat. One skilled in the art will appreciate how the protrusion 227 and the shoulder 228 may have opposite mating surfaces to be flush against each other. Further, elastomer or metal seals 229 may be provided between the first seat pocket insert 200 and the second portion 221 to seal an outer surface of the seat with a surface of the profile 219. When the seat 204 abuts the first seat pocket insert 200, one skilled in the art will appreciate how the bore 217 of the first portion 220 of seat pocket insert 200 may be coaxial with a bore 218 of the second portion 221. It is further envisioned that a ring or collar 230 may be used to coaxially align the first seat pocket insert 200 and the seat. In a non-limiting example, the collar 230 may sit in a recess or groove 231 of the seat 204 to match the bore 218 of the seat to the bore 217 of the first seat pocket insert 200. In addition, the bore 217 of the first seat pocket insert 200 may have an inner diameter that is equal to an inner diameter of the bore 218 of the seat 221.

The seat pocket insert 200 as shown in FIG. 5 is for use in a terminal inlet or outlet flow bore seat pocket of a valve. A seat pocket insert may be used for a terminal bore in a cross flow block (i.e., where the cross flow block is first or last). In this instance, however, the second portion 221 (seat seal) is not necessary, as there are no internal moving parts, and only a seat pocket insert similar to first portion 220 may be required. The second end surface 215 may have a different profile, as well, as a profile or recess to connect to the second portion 221 is not required.

Referring now to FIG. 6, a seat pocket insert 300 for use in coupling a gate valve block 301 to a cross flow block 302 is illustrated (e.g., a valve block to flow block sealing system). Seat pocket insert 300 may be a unitary body and may include a threaded seat pocket insert portion 300A, disposed within a seat pocket of valve block 301, and a stab interface portion 300B, disposed within a seat pocket 303 of cross flow block 302. As associated with a valve, the portion 300A of the seat pocket insert 300 and lower seat seal portion 221 as disposed within valve block 301 may be similar or identical to that as described for the terminal valve block seat pocket insert 200 of FIG. 5, and such description is not repeated here.

Cross flow block 302 may include a bore 304 terminating at seat pocket 303, which may be a section of bore 304 having a larger inner diameter. The seat pocket 303 may include a profile 305 for receiving the stab insert, and may also include a secondary profile 306 for receiving and interacting with a load shoulder 307 of stab portion 300B. While it is noted that FIG. 6 shows the load shoulder 307 at a ninety-degree angle, one of skill in the art would understand that this is merely a non-limiting example and the load shoulder 307 may be any angle without departing from the present scope of the disclosure.

Stab portion 300B may be unthreaded, and may be compression fit within the seat pocket 303. A plurality of seals 309 may be provided in ring grooves 310 to seal an outer surface of the stab portion 300B to an inner surface of the seat pocket 303 of cross flow block 302. Additionally, the plurality of seals 309 may aid in preventing leaks between the seat pocket insert 300 and the body 302 of the cross flow block. The plurality of seals 309 may be elastomer or metal.

The flow bores 304, 217, 218 may be aligned, such that a continuous flow path is provided from the valve element 236 to the internal bores of the cross-flow block. The threaded portion 300A may land load shoulder 225 on shoulder 235 of the valve block 301. In this manner, the floating operation of the seat seal 221 is not interfered with by over-compressing the modular valve tree assembly. Ease of assembly is provided by stab portion 300B, which may have tolerances to both accommodate compression of the blocks during assembly, while maintaining sealing capability and minimal gaps between the seat insert and the seat pocket 303 so as to avoid unnecessary eddies or erosion paths.

As illustrated in FIG. 4, cross flow block 104 is connected to two valve block 102, 106. The lower portion of the vertical flow bore for cross flow block 104 may be fluidly sealed and connected to an upper flow bore of the master valve block 102 using a first seat pocket insert 300. The upper portion of the vertical flow bore for cross flow block 104 may be fluidly sealed and connected to a lower flow bore of swab valve block 106 using a second seat pocket insert 300. As would be appreciated by one skilled in the art, the first and second seat pocket inserts 300 may be similar, but may be inverted with respect to one another, the cross flow block receiving a stab portion of both respective inserts disposed within each of the respective upper and lower seat pockets.

Referring now to FIG. 7, a seat pocket insert 400 for use in coupling two gate valves is illustrated (e.g., a valve block to valve block sealing system). Seat pocket insert 400 may include a first seat pocket insert part 402 to be disposed within a respective threaded seat pocket of a first valve block 404. Seat pocket insert 400 may also include a second seat pocket insert part 406 to be disposed within a respective threaded seat pocket of a second valve block 408.

Each of the seat pocket insert parts 402, 406 may be identical, simply inverted as illustrated. Further, the seat pocket insert parts 402, 406 and respective lower seat seal portions 221, as disposed within a valve block 404, 408, may be similar or identical to that as described for the terminal valve block seat pocket insert 200 of FIG. 5, and such description is not repeated here (while not all references numerals are included in FIG. 7, one skilled in the art would recognize the corresponding portions of the respective inserts).

Each seat pocket insert part 402, 406 may include a seat pocket or profile 415 for receiving a sealing element insert 420, which may be partially disposed within both seat pocket insert parts 402, 406, and thus partially disposed within each of valve blocks 404, 408. Sealing element insert 420 may be compression fit within the seat pockets 415. A plurality of seals 422 may be provided in ring grooves 425 to seal an outer surface of the sealing element insert 420 to an inner surface of the seat pockets 415. The plurality of seals 422 may be elastomer or metal.

The respective flow bores of the seat seals 221, the seat pocket inserts 402, 406, and the sealing element insert 420 may be aligned, such that a continuous flow path is provided from the valve element 236 of the first valve block 404 to the valve element 236 of the second valve block 408. The threaded portion of the inserts 402, 406 may land load shoulders 225 on respective shoulders 235 of the valve blocks 404, 408. In this manner, the floating operation of the seat seals 221 are not interfered with by over-compressing the modular valve tree assembly. Ease of assembly is provided by sealing element insert 420, which may have tolerances to both accommodate compression of the blocks during assembly, while maintaining sealing capability and minimal gaps between the seat insert and the seat pockets 415 so as to avoid unnecessary eddies or erosion paths.

It is recognized by the present inventor that the coupling systems provided between blocks of the trees herein may result in extra leak paths. However, the benefits of maintenance and replacement capabilities (re-work costs) has been found to far outweigh the concerns with respect to additional leak paths. Using a disposable insert eliminates the need for weld repair in the seat pocket and ring groove areas. Further, with respect to the valve to valve coupling and sealing system, it is noted that the use of a sealing element insert may allow separate testing of all valves. One skilled in the art will further appreciate that when using a non-disposable insert, the coupling systems provided between blocks of the trees herein may be easily disassembled to allow for repairs such as additional machining or welding to localized areas in the blocks. In contrast, conventional composite valve block repairs require welding to every sealing element to avoid having hardness reduction after a few different hot weld procedures.

Figure 8:
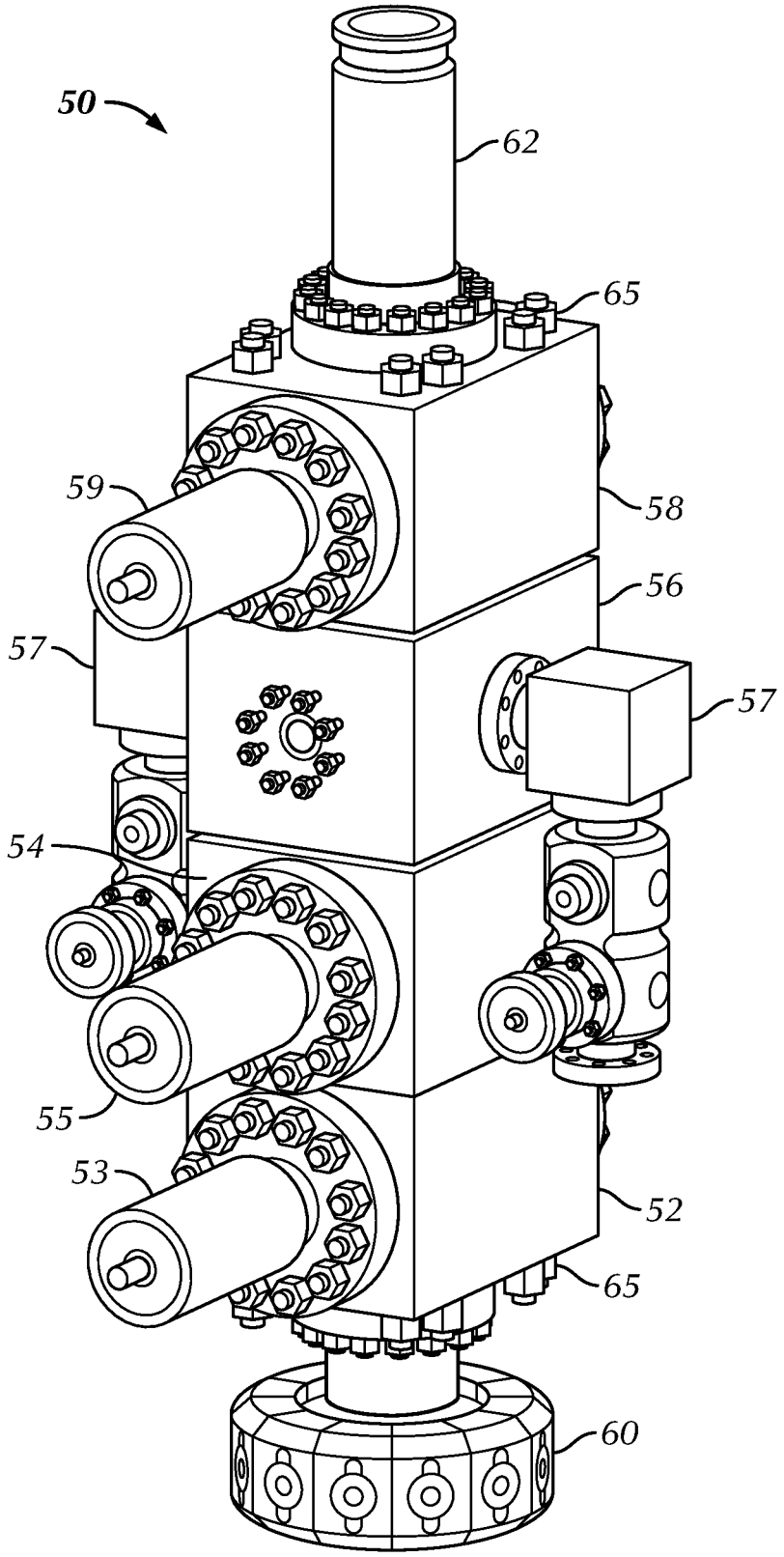
FIG. 8 is a perspective view of a modular tree assembly according to embodiments herein.

Referring now to FIG. 8, another embodiment of a Christmas tree assembly according to embodiments herein is illustrated, where like numerals represent like parts. The embodiment of FIG. 8 is similar to that of the embodiment of FIG. 2. However, in place of strength arms (see 64 in FIG. 2), the component parts are assembled and maintained together using threaded posts 65. The retention system may include, for example, one or more threaded posts 65 extending through the two or more blocks of the modular valve tree, and each of the two or more blocks may include through-holes aligned and configured to receive the threaded posts. Nuts or other means may be tightened (torqued) to compress and engage one or more of the sealing elements.

Figure 9:
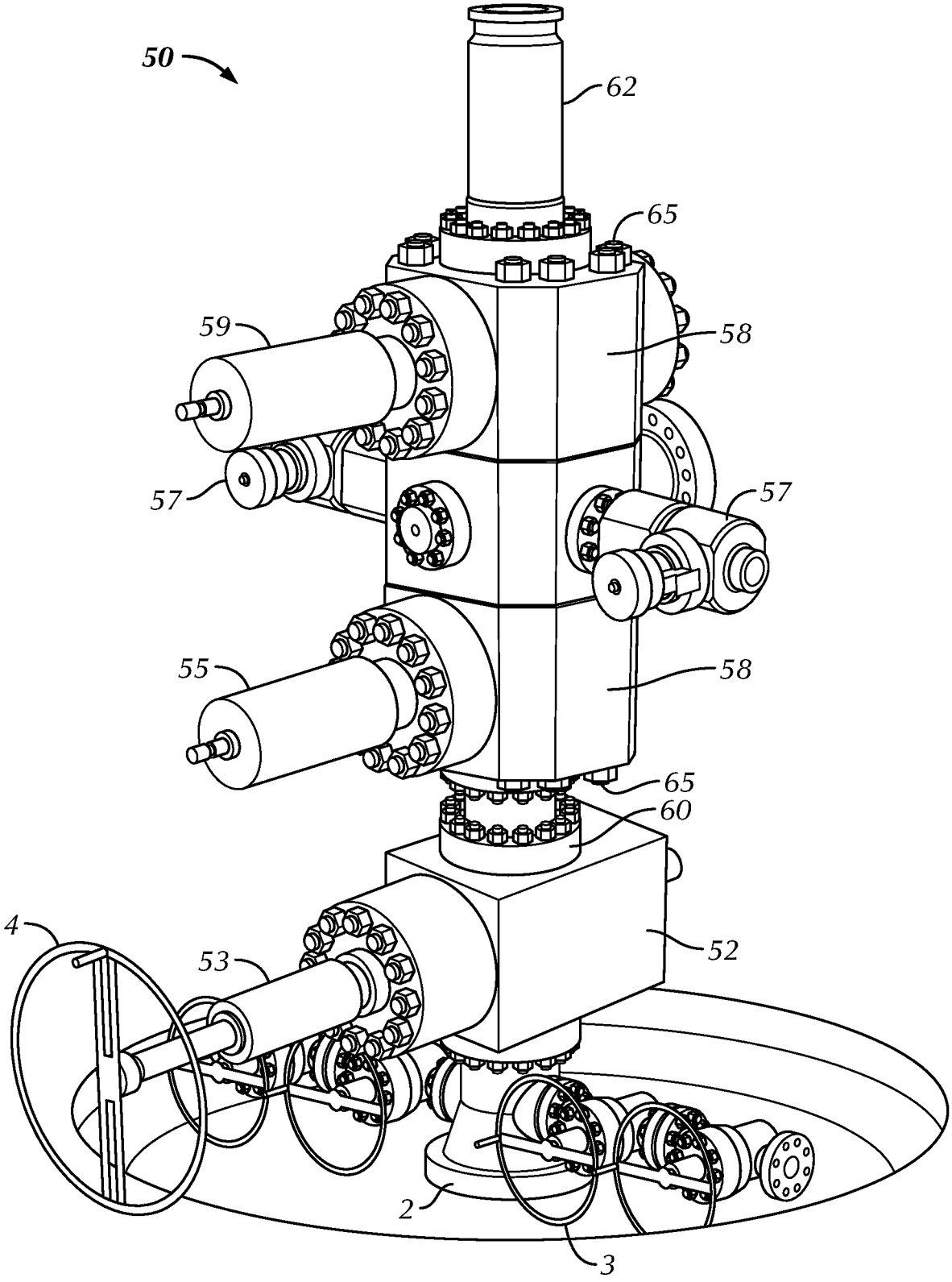
FIG. 9 is a perspective view of a modular tree assembly according to embodiments herein.

Referring now to FIG. 9, another embodiment of a Christmas tree assembly according to embodiments herein is illustrated, where like numerals represent like parts. The embodiment of FIG. 9 is similar to that of the embodiment of FIG. 8. However, in the embodiment of FIG. 9, the lower master valve block 52 is already present at a wellsite and attached to a wellhead 2 via a flanged spool 3 or any mechanical coupler. As further shown in FIG. 9, a wheel 4 may be coupled to the valve element 53 to allow easy access to the lower master valve block 52. Additionally, the lower adapter 60 may be attached on a top of the lower master valve block 52. Further, an assembly of the master valve block 54, the cross-flow block 56, and the swab valve block 58 may be lowered onto the lower adapter 60 to form the continuous flow path (internal) from the upper adapter 62 to the wellhead 2.

Figure 10A:
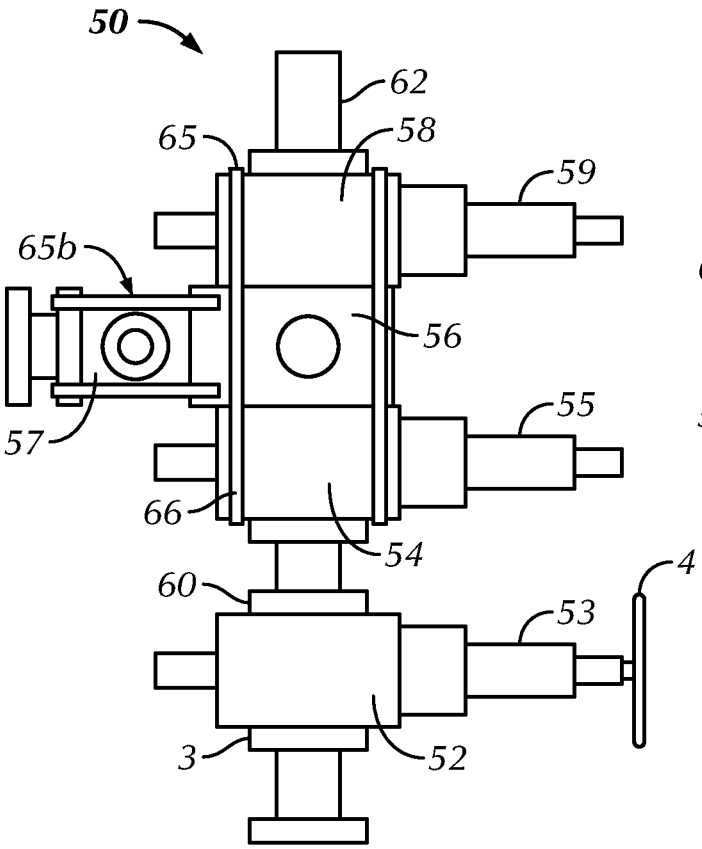
FIGS. 10A and 10B are side views of a modular tree assembly according to embodiments herein.
Figure 10B:
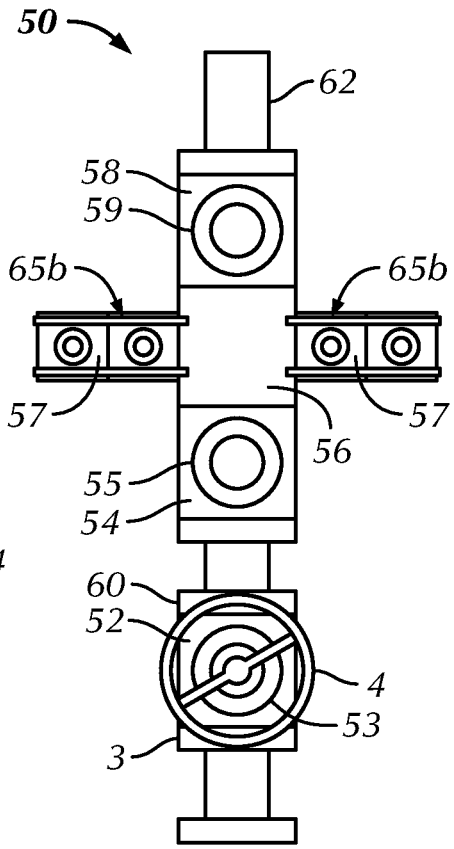

Referring now to FIGS. 10A and 10B, another embodiment of a Christmas tree assembly according to embodiments herein is illustrated, where like numerals represent like parts. The embodiment of FIGS. 10A and 10B are similar to that of the embodiment of FIG. 9. However, in the embodiment of FIGS. 10A and 10B, the modular valve tree 50 may include horizontal threaded posts 65*b* studded onto the cross-flow block 56. In one or more embodiments, FIG. 10A illustrates the wing block 57, such as isolation and gate valves, may be through-studded with the horizontal threaded posts 65*b* to the cross-flow block 56. In some embodiments, FIG. 10B illustrates the wing block 57, such as wing and plug valves, on two sides of the cross-flow block 56 and both wing valves 57 may be through-studded with the horizontal threaded posts 65*b* to the cross-flow block 56. The threaded posts 65*b* may be used to assemble, maintain, and improve the stability of the wing block 57 coupled to the cross-flow block 56. In a non-limiting example, the threaded posts 65*b* extending through the wing block 57 into the cross-flow block 56, and each of the wing block 57 and the cross-flow block 56 may include through-holes aligned and configured to receive the threaded posts. Nuts or other means may be tightened (torqued) to compress and engage one or more of the sealing elements.

Further, the valves attached to the cross-flow block 56 in such a manner may include seat pocket inserts, similar to those for the vertical flow path of the Christmas tree. The through studding connecting the branch valves to the cross-flow block may engage the seals of the branch seat pocket inserts, similar to that as described above for the vertical flow path seat pocket inserts. Use of the branch seat pocket inserts and through studding may also allow compact assembly of the horizontal flow paths and a further reduction in the number of bolts used for assembly.

Furthermore, one skilled in the art will appreciate how the modular valve assemblies as disclosed in embodiments herein may have the blocks in any arrangement from top to bottom (or side to side) within the modular valve tree without departing from the scope of the present invention. While embodiments herein may be disclosed with a cross flow block sandwiched between valve blocks, not all embodiments are so limited, and the cross flow blocks and valve blocks may be arranged in any order, including two adjacent cross flow blocks or other arrangements as may be envisioned by one skilled in the art based on the present disclosure. The compact "stackability" of the valve blocks and flow blocks may provide for any number of unique arrangements that provide for flow control and flow branching to or from a well. Additionally, one skilled in the art will appreciate how, in addition to trees, the modular valves disclosed in embodiments herein may be used in additional places where two or more valves may be placed in series, such as a frac manifold leg. Further, it is envisioned at that the modular valve assemblies as disclosed in embodiments herein may have the blocks accommodate various sizes. In some embodiments each blocks is the same size configured for an operation of use. Additionally, based on the operation of use, the blocks may be different sizes ability to accommodate multiple arrangements and configurations of the modular valve assemblies. One skilled in the art will appreciate how the cross-flow block of the modular valve assemblies may be sized and designed to allow different valves to be used in the modular valve assemblies for different operations.

In another aspect, embodiments herein relate to a method of assembling a modular valve tree. The method may include disposing a seat pocket insert within a seat pocket of a first block. A second block may then be disposed adjacent to the first block, where a portion of the seat pocket insert is also disposed within a seat pocket of the second block. The method may also include assembling a retention system configured to retain the blocks in position. Assembly of the retention system may include or result in compressing and engaging one or more sealing elements of the seat pocket insert. In some embodiments, assembling the retention system may include disposing one or more threaded posts extending through the first and second blocks. In other embodiments, assembling the retention system may include securing an external frame around the blocks, such that the external frame extends across the first block and the second block. Assembling the retention system may also include aligning one or more alignment elements formed on the first block with one or more alignment elements formed on the second block.

Conventional valve blocks in the oil and gas industry are typically very large and heavy. Advantageously, embodiments disclosed herein may provide for a modular valve tree that is compact, fitting within DOT regulations for standard transportation to the wellsite. For example, embodiments herein may decrease a height of a tree, which for a standard tree as illustrated in FIG. 1 may be on the order of 180 inches in height, to a height of approximately 150 to 155 inches, a savings of about 2.5 feet for some embodiments having comparable valving and flow configurations to a "typical" tree. Further, the weight of the tree according to embodiments herein may be reduced compared to a standard tree. Designs according to embodiments herein additionally may reduce the amount of flange adapters between valves. As a result, the overall number of leak paths and bolts used during assembly may also be reduced, such as by 20% to 30% for each.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A modular valve tree, comprising:

two or more blocks, including:

a first block having a flow passage therethrough, including an inlet and an outlet;

a second block having a flow passage therethrough, including an inlet and an outlet;

an insert comprising sealing elements, wherein:

the insert is partially disposed within each of the first block and the second block, the insert has a throughbore fluidly connecting the first block outlet to the second block inlet; and the sealing elements are configured to seal external surfaces of the insert against an internal surface of the respective flow passages;

a retention system configured to retain the blocks in position and compress and engage one or more of the sealing elements;

wherein the insert comprises:

a first seat pocket insert part configured to be disposed within a respective threaded seat pocket of the first block outlet, the first seat pocket insert part further including a seat pocket; and a second seat pocket insert part configured to be disposed within a respective threaded seat pocket of the second block inlet, the second seat pocket insert part further including a seat pocket; and a sealing element disposed within and sealing against each of the seat pockets of the first and second seat pocket insert parts.

2. The modular valve tree of claim 1, wherein the two or more blocks include at least one valve block, at least one cross flow block, or combinations thereof.

3. The modular valve tree of claim 1, wherein the retention system comprises one or more threaded posts extending through the two or more blocks, and wherein each of the two or more blocks comprises one or more through-holes to receive the threaded posts.

4. The modular valve tree of claim of claim 1, wherein the retention system comprises one or more strength arms, and wherein each of the two or more blocks each comprise one or more notches configured to engage the strength arms.

5. The modular valve tree of claim 1, wherein the two or more blocks each include alignment features configured to align adjacent blocks during assembly.

6. The modular valve tree of claim 1, wherein the first block comprises a gate valve block and wherein the second block comprises a gate valve block.

7. The modular valve tree of claim 1, wherein the first block comprises a gate valve block and wherein the second block comprises a cross flow block.

8. The modular valve tree of claim 1, wherein the first block comprises a cross flow block and wherein the second block comprises a gate valve block.

9. The modular valve tree of claim 1, wherein the two or more blocks are arranged vertically, and wherein an uppermost and/or a lowermost of the two or more blocks comprise an insert configured to connect to a flanged or studded fluid connection or a blind flange.

10. A modular valve tree, comprising:

a first gate valve block;

a second gate valve block disposed adjacent to and fluidly connected to the first gate valve block;

a cross flow block disposed adjacent to and fluidly connected to the second gate valve block;

a third gate valve block disposed adjacent to and fluidly connected to the cross flow block;

a first insert sealingly disposed within a seat pocket of the first gate valve block and a seat pocket of the second gate valve block;

a second insert sealingly disposed within a seat pocket of the second gate valve block and a seat pocket of the cross flow block;

a third insert sealingly disposed within a seat pocket of the cross flow block and the third gate valve block; and a retention system configured to retain each of the blocks in position and compress and engage one or more sealing elements of the first insert, the second insert, and the third insert.

11. A method of assembling a modular valve tree, the method comprising:

disposing an insert within a seat pocket of a first block;

disposing a second block adjacent to the first block, wherein a portion of the insert is disposed within a seat pocket of the second block;

assembling a retention system configured to retain the blocks in position, wherein assembly of the retention system compresses and engages one or more sealing elements of the insert, wherein assembling the retention system comprises securing an external frame around the blocks, such that the external frame extends across the first block and the second block.

12. The method of claim 11, wherein assembling the retention system comprises disposing one or more threaded posts extending through the first and second blocks.

13. The method of claim 11, wherein assembling the retention system comprises aligning one or more alignment elements formed on the first block with one or more alignment elements formed on the second block.

* * * * *